US010229666B2

(12) United States Patent
Hanazono et al.

(10) Patent No.: US 10,229,666 B2
(45) Date of Patent: Mar. 12, 2019

(54) SIGNAL PROCESSING DEVICE, PROGRAM, AND RANGE HOOD DEVICE

(71) Applicant: Panasonic Intellectual Property Management Co., Ltd., Osaka (JP)

(72) Inventors: Masaya Hanazono, Osaka (JP); Wakio Yamada, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 73 days.

(21) Appl. No.: 15/501,345

(22) PCT Filed: Jul. 9, 2015

(86) PCT No.: PCT/JP2015/003476

§ 371 (c)(1),
(2) Date: Feb. 2, 2017

(87) PCT Pub. No.: WO2016/021114

PCT Pub. Date: Feb. 11, 2016

(65) Prior Publication Data

US 2017/0229111 A1 Aug. 10, 2017

(30) Foreign Application Priority Data

Aug. 5, 2014 (JP) ..... 2014-159770

(51) Int. Cl.
*F24C 15/20* (2006.01)
*G10K 11/178* (2006.01)

(52) U.S. Cl.
CPC ..... *G10K 11/178* (2013.01); *F24C 15/20* (2013.01); *F24C 15/2042* (2013.01);
(Continued)

(58) Field of Classification Search
CPC ..... F24C 15/2042
(Continued)

(56) References Cited

U.S. PATENT DOCUMENTS 5,471,537 A * 11/1995 Castwall ..... F04D 29/663 181/224
5,502,770 A * 3/1996 Kuo ..... G10K 11/178 381/71.14

(Continued)

FOREIGN PATENT DOCUMENTS

JP 07-219563 A 8/1995
JP 2009-210700 A 9/1995

(Continued)

OTHER PUBLICATIONS

International Search Report for corresponding International Application No. PCT/JP2015/003476 dated Aug. 4, 2015.

(Continued)

*Primary Examiner* — Avinash Savani
(74) *Attorney, Agent, or Firm* — Renner, Otto, Boisselle & Sklar, LLP

(57) ABSTRACT

A signal processing device includes a coefficient updater configured to calculate a filter coefficient based on a reference signal, an error signal, and an update parameter to set the filter coefficient in a noise cancelling filter. A parameter adjuster adjusts the update parameter according to fluctuation of the reference signal produced from an output of a reference microphone.

20 Claims, 7 Drawing Sheets

(52) U.S. Cl.
CPC .. *G10K 11/17853* (2018.01); *G10K 11/17881* (2018.01); *G10K 2210/105* (2013.01); *G10K 2210/3016* (2013.01); *G10K 2210/3026* (2013.01); *G10K 2210/3027* (2013.01); *G10K 2210/3028* (2013.01)

(58) Field of Classification Search
USPC ..... 126/299 R
See application file for complete search history.

(56) References Cited

U.S. PATENT DOCUMENTS

| | | | | |
|---|---|---|---|---|
| 6,654,467 | B1 * | 11/2003 | York | G10K 11/178 381/71.14 |
| 8,054,984 | B2 * | 11/2011 | Klossowski | G10K 11/178 381/71.14 |
| 2005/0276422 | A1 * | 12/2005 | Buswell | G10K 11/178 381/71.14 |
| 2007/0076896 | A1 | 4/2007 | Hosaka et al. | |
| 2010/0002892 | A1 | 1/2010 | Togawa et al. | |
| 2013/0311040 | A1 | 11/2013 | Hasegawa et al. | |
| 2013/0315408 | A1 | 11/2013 | Yano et al. | |

FOREIGN PATENT DOCUMENTS

| | | | |
|---|---|---|---|
| JP | 09-195791 | A | 7/1997 |
| JP | 2007-93962 | A | 4/2007 |
| JP | 2007-243437 | A | 9/2007 |
| JP | H07-248784 | A | 9/2009 |
| JP | 2012-123135 | A | 6/2012 |
| JP | 2013-104911 | A | 5/2013 |
| JP | 5326056 | B2 | 7/2013 |
| JP | 2014-077906 | A | 5/2014 |
| WO | WO 2008/126287 | A1 | 10/2008 |
| WO | WO 2012/153451 | A1 | 11/2012 |

OTHER PUBLICATIONS

Form PCT/ISA/237 for corresponding International Application No. PCT/JP2015/003476 dated Aug. 4, 2015.

* cited by examiner

SIGNAL PROCESSING DEVICE, PROGRAM, AND RANGE HOOD DEVICE

TECHNICAL FIELD

The present invention relates generally to signal processing devices, programs, and range hood devices, and more specifically to a signal processing device and a program for performing active noise control, and a range hood device including the signal processing device.

BACKGROUND ART

A known noise cancelling device involves active noise control as a technique for reducing noise generated from a noise source and propagating in a space (noise propagation space). The active noise control is a technique for actively reducing noise by outputting a cancelling sound having an antiphase to the phase of the noise and having an amplitude identical with the amplitude of the noise.

As a conventional technique (for example, see Document 1 "JP H07-219563 A"), a configuration is disclosed in which a least mean square (LMS) algorithm is used to update the filter coefficient of a finite impulse response (FIR) adaptive digital filter, thereby generating a cancelling sound. The LMS algorithm calculates the filter coefficient by using an update parameter (step size parameter: parameter defining the magnitude of a correction amount in repetition). In the conventional technique, noise is a target to be cancelled, and when sounds (disturbance sounds) other than the noise are loud, the value of the update parameter is reduced to increase resistance to the disturbance sound, whereas when the disturbance sounds are small, the value of the update parameter is increased to enhance noise cancellation performance.

In general, noise fluctuates depending on environmental conditions such as temperatures, humidity, and atmospheric pressures. For example, noise of a range hood device fluctuates depending on changes in static pressure, changes in temperature, etc. in a duct. However, the disturbance sounds in the above-described conventional technique are sounds generated independently of the noise which is a target to be cancelled. In the conventional technique, it has been difficult to cancel the noise which fluctuates depending on changes in environmental conditions.

SUMMARY OF INVENTION

In view of the foregoing, it is an object of the present invention to provide a signal processing device, a program, and a range hood device which enable highly accurate cancellation of noise which fluctuates depending on changes in environmental conditions.

A signal processing device of one aspect according to the present invention is used in combination with a sound input/output device including a first sound input device disposed in a space in which noise output from a noise source propagates, the first sound input device being configured to collect the noise, a sound output device configured to receive a cancellation signal to output a cancelling sound for cancelling the noise to the space, and a second sound input device configured to collect a synthesis sound of the noise and the cancelling sound in the space. The signal processing device includes: a cancellation signal generator which includes a sound cancelling filter having a filter coefficient and which is configured to receive a first signal generated based on an output of the first sound input device to output the cancellation signal; a first signal converter configured to output a second signal obtained by correcting the first signal based on a transfer function of an acoustic passage from the sound output device to the second sound input device; a coefficient updater configured to calculate a new filter coefficient based on the second signal, a third signal generated from an output of the second sound input device, and an update parameter relating to a magnitude of a correction amount of the filter coefficient, and update the filter coefficient of the sound cancelling filter to the new filter coefficient; and a parameter adjuster configured to adjust the update parameter in response to output fluctuation of the first sound input device.

A program of one aspect according to the present invention causes a computer to function as a signal processing device.

A range hood device of an aspect according to the present invention includes: an air passage which is hollow; an air blowing device configured to generate an airflow from a first end toward a second end of the air passage; a first sound input device disposed in the air passage to collect noise generated from the air blowing device; a sound output device configured to receive a cancellation signal to output a cancelling sound for cancelling the noise in the air passage; a second sound input device configured to collect a synthesis sound of the noise and the cancelling sound in the air passage; and the signal processing device, wherein the second sound input device, the sound output device, and the first sound input device are arranged in this order from the first end toward the second end of the air passage.

The signal processing device, the program, and the range hood device can highly accurately cancel noise which fluctuates depending on changes in environmental conditions.

DESCRIPTION OF EMBODIMENT

An embodiment of the present invention will be described below with reference to the drawings.

(Embodiment)

Figure 1:
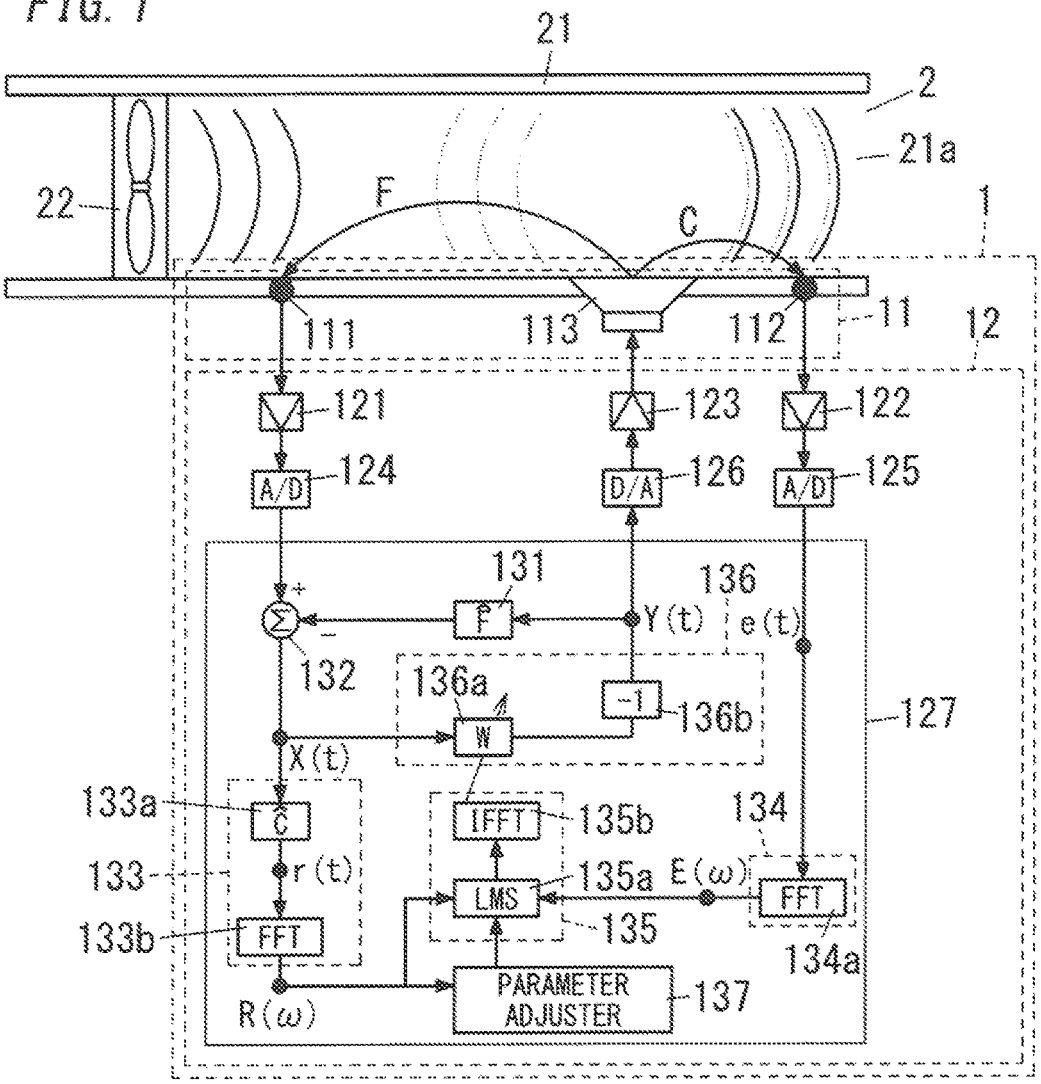
FIG. 1 is a block diagram illustrating a configuration example of a range hood device of an embodiment.

FIG. 1 shows the configuration of a noise cancelling device 1 (active noise control device) of the present embodiment. The noise cancelling device 1 is used in combination with a range hood device 2.

Figure 2:
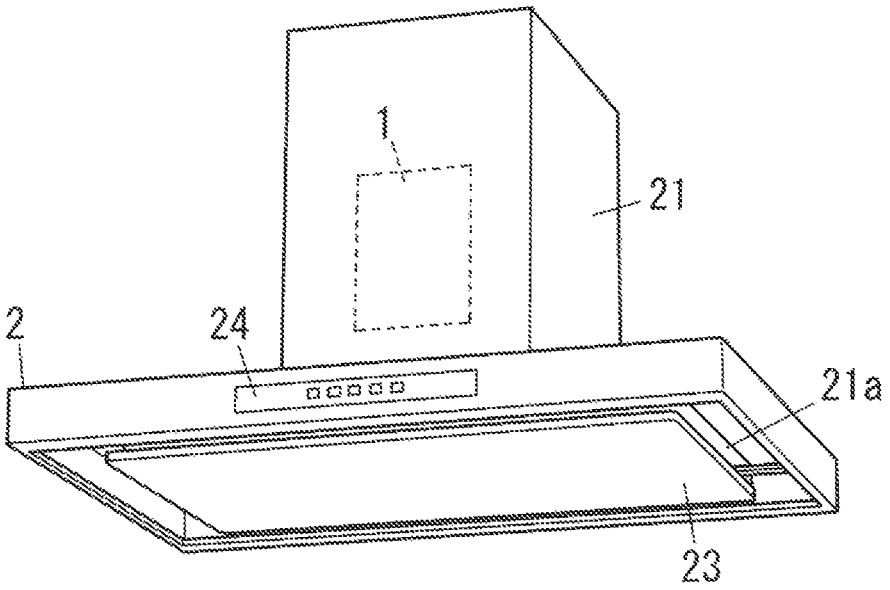
FIG. 2 is a perspective view illustrating the exterior of the range hood device of the embodiment.

As illustrated in FIG. 2, the range hood device 2 includes a duct 21 (air passage) disposed above kitchen appliances in a kitchen room. The duct 21 has a box shape whose lower surface is provided with an inlet 21*a*. The duct 21 accommodates a fan 22 (air blowing device, see FIG. 1) configured to suck indoor air into the duct 21 via the inlet 21*a* to release the indoor air outdoors. The range hood device 2 includes a straightening plate 23. The inlet 21*a* is located around the straightening plate 23 (see FIG. 2). The straightening plate 23 improves the air intake efficiency. The range hood device 2 has a front surface provided with an operation section 24. The operation section 24 includes operation switches for operating the range hood device 2, and an indicator for indicating operational states (see FIG. 2). In the duct 21, a space forming an air passage corresponds to a space in which noise generated from a noise source propagates.

When the fan 22 operates, the fan 22 serves as the noise source, an operational sound (noise) of the fan 22 propagates in the duct 21, and the operational sound is transmitted from the inlet 21*a* to the room. In order to reduce the noise transmitted to the room during the operation of the fan 22, the duct 21 is provided with the noise cancelling device 1.

As illustrated in FIG. 1, the noise cancelling device 1 installed in the duct 21 includes a sound input/output device 11 and a signal processing device 12.

The sound input/output device 11 includes a reference microphone 111 (first sound input device), an error microphone 112 (second sound input device), and a loudspeaker (sound output device) 113. The reference microphone 111 is located in the vicinity of the fan 22 in the duct 21. The error microphone 112 is located in the vicinity of the inlet 21*a* in the duct 21. The loudspeaker 113 is located between the reference microphone 111 and the error microphone 112 in the duct 21. That is, in the space, the reference microphone 111, the loudspeaker 113, and the error microphone 112 are arranged in this order from the fan 22 to the inlet 21*a*.

The signal processing device 12 includes amplifiers 121, 122, and 123, A/D converters 124, 125, a D/A converter 126, and a noise cancellation controller 127.

An analog signal output from the reference microphone 111 is amplified in the amplifier 121 and is then subjected to A/D conversion in the A/D converter 124 to obtain a digital signal. The digital signal is output from the A/D converter 124 and is input to the noise cancellation controller 127.

An analog signal output from the error microphone 112 is amplified in the amplifier 122 and is then subjected to A/D conversion in the A/D converter 125 to obtain a digital signal. The digital signal is output from the A/D converter 125 and is input to the noise cancellation controller 127.

A cancellation signal output from the noise cancellation controller 127 is subjected to D/A conversion in the D/A converter 126 and is then amplified in the amplifier 123. The loudspeaker 113 receives the cancellation signal amplified in the amplifier 123 to output a cancelling sound.

The noise cancellation controller 127 includes a computer configured to execute a program. In order to minimize a sound level at an installation point (noise cancellation point) of the error microphone 112, the noise cancellation controller 127 outputs from the loudspeaker 113, the cancelling sound for cancelling the noise from the fan 22. That is, the loudspeaker 113 outputs the cancelling sound, thereby reducing the noise to be transmitted from the fan 22 through the inlet 21*a* to the outside of the duct 21. The noise cancellation controller 127 performs active noise control, and in order to follow a noise change of the fan 22 serving as the noise source and a change in noise propagation characteristic, the noise cancellation controller 127 executes a noise cancellation program which provides a function of an adaptive filter. To update the filter coefficient of the adaptive filter, a Filtered-X Least Mean Square (LMS) sequential update control algorithm is used.

As the computer included in the noise cancellation controller 127, a processor which operates according to a program and an interface are included as main hardware configurations. Examples of such a processor include a Digital Signal Processor (DSP), a Central Processing Unit (CPU), and a Micro-Processing Unit (MPU). There is no restriction on the type of a processor as long as the processor can provide the following functions of the signal processing device 12 by executing programs.

Moreover, the programs may be provided, for example, in a form stored in a non-transitory computer-readable recording medium such as read only memory (ROM) or an optical disk, or in a form supplied to a recording medium via a wide-area communication network such as the Internet.

Operation of the signal processing device 12 will be described below.

The reference microphone 111 collects noise generated from the fan 22 and outputs a noise signal corresponding to the noise, which was collected, to the signal processing device 12. The amplifier 121 amplifies the noise signal. The A/D converter 124 performs A/D conversion of the noise signal, which was amplified in the amplifier 121, at a predetermined sampling frequency to obtain a discrete value. The A/D converter 124 outputs the discrete value to the noise cancellation controller 127.

The error microphone 112 collects residual noise which has not been cancelled by the cancelling sound at the noise cancellation point, and the error microphone 112 outputs an error signal corresponding to the collected residual noise to the signal processing device 12. The A/D converter 125 performs A/D conversion of the error signal, which was amplified in the amplifier 122, at the same sampling frequency as the sampling frequency of the A/D converter 124 to obtain a discrete value. The A/D converter 125 outputs the discrete value as an error signal e(t) in a time domain to the noise cancellation controller 127.

The noise cancellation controller 127 includes a howling cancel filter 131, a subtractor 132, a first signal converter 133, a second signal converter 134, a coefficient updater 135, a cancellation signal generator 136, and a parameter adjuster 137. The first signal converter 133 includes a correction filter 133*a* and a converter 133*b*. The second signal converter 134 includes a converter 134*a*. The coefficient updater 135 includes a coefficient setter 135*a* and an inverse converter 135*b*. The cancellation signal generator 136 includes a sound cancelling filter 136*a* and an inverter 136*b*.

The howling cancel filter 131 is a Finite Impulse Response (FIR) filter in which a transfer function $\hat{F}$ simulating a transfer function F of a sound wave from the loudspeaker 113 to the reference microphone 111 is set as a filter coefficient. Note that the transfer function simulating the transfer function F is denoted by the symbol $\hat{F}$ which is a symbol F provided with a chevron symbol (hat symbol)ˆ . In this specification, the symbol ˆ is arranged obliquely above F, and in FIGS. 1 and 4, the symbol ˆ is arranged directly above F, but in both cases, F provided with the symbol ˆ represents a transfer function simulating the transfer function F.

The howling cancel filter 131 performs convolution of the transfer function $\hat{F}$ on a cancellation signal Y(t) output from the cancellation signal generator 136. Then, the subtractor 132 outputs a signal obtained by subtracting an output of the howling cancel filter 131 from the signal output from the A/D converter 124. That is, a signal obtained by subtracting a wraparound component of the cancelling sound from the noise signal collected by the reference microphone 111 is output as a noise signal X(t) (first signal) from the subtractor 132. Therefore, even if the cancelling sound output from the loudspeaker 113 wraps around the reference microphone 111, the occurrence of howling can be prevented. The noise signal X(t) output from the subtractor 132 is input to the sound cancelling filter 136a and the correction filter 133*a*.

The sound cancelling filter 136*a* is a FIR adaptive filter having filter coefficients W(t) set by the coefficient updater 135. The sound cancelling filter 136*a* of the present embodiment divides the entire frequency band of the cancelling sound by n to obtain a plurality of frequency bins, and in each of the plurality of frequency bins, a corresponding one of filter coefficients W1(t) to Wn(t) is set by the coefficient updater 135. Note that when the filter coefficients W1(t) to Wn(t) in a time domain are not distinguished from each other, the filter coefficients are referred to as filter coefficients W(t).

The correction filter 133*a* is a FIR filter in which a transfer function Cˆ is set as a filter coefficient. The transfer function Cˆ simulates a transfer function C of a sound wave which reaches the error microphone 112 from the loudspeaker 113. The correction filter 133*a* performs convolution of the noise signal X(t) output from the subtractor 132 and the transfer function Cˆ, and an output from the correction filter 133*a* is input as a reference signal r(t) in a time domain to the converter 133*b*. The converter 133*b* converts the reference signals r(t) in the time domain into a reference signal R(ω) (second signal) in a frequency domain by Fast Fourier Transform (FFT). That is, the first signal converter 133 outputs the reference signal R(ω) in the frequency domain after correcting the noise signal X(t) based on the transfer function Cˆ to the coefficient setter 135*a* and the parameter adjuster 137. Note that the transfer function simulating the transfer function C is denoted by the symbol Cˆ which is a symbol C provided with a chevron symbol ˆ. In this specification, the symbol ˆ is arranged obliquely above C, and in FIGS. 1 and 4, the symbol ˆ is arranged directly above C, but in both cases, C provided with the symbol ˆ represents a transfer function simulating the transfer function C.

The converter 134*a* of the second signal converter 134 converts the error signals e(t) in the time domain into an error signal E(ω) (third signal) in the frequency domain by FFT. That is, the second signal converter 134 outputs the error signal E(ω) in the frequency domain to the coefficient setter 135*a*.

The coefficient setter 135*a* of the coefficient updater 135 uses a known sequential update control algorithm, Filtered-X LMS, in a frequency domain to update the filter coefficients W1(ω) to Wn(ω) of the sound cancelling filter 136*a*. This coefficient setter 135*a* calculates the filter coefficients W1(ω) to Wn(ω) of the sound cancelling filter 136*a* based on the reference signals R(ω) output from the first signal converter 133 and the error signals E(ω) output from the second signal converter 134. Note that when the filter coefficients W1(ω) to Wn(ω) in a frequency domain are not distinguished from each other, the filter coefficients are referred to as filter coefficients W(ω).

Moreover, when the filter coefficients W(t) in the time domain and the filter coefficients W(ω) in the frequency domain are not distinguished from each other, the filter coefficients are referred to as filter coefficients W.

In general, in update processing of the filter coefficients W(ω) using the Filtered-X LMS in the frequency domain, each filter coefficient W(ω) is updated such that the error signal E(ω) is minimum. Specifically, when each filter coefficient is denoted by W(ω), the update parameter is denoted by μ, and a sample number is denoted by m, the update processing of the filter coefficient W(ω) is expressed as Formula 1. Note that the update parameter μ is also referred to as a step size parameter and is a parameter for determining the magnitude of the correction amount of each filter coefficient W(ω) in a process for repeatedly calculating the filter coefficient W(ω) by using, for example, the LMS algorithm.

$$W_{m+1}(\omega)=W_m(\omega)+2\mu R_m(\omega)E_m(\omega) \quad \text{[Formula 1]}$$

Here, in Formula 1, as the second term including the reference signal R(ω), the error signal E(ω), and the update parameter μ on the right increases, a least square error is reached more rapidly, and the filter coefficient W(ω) more rapidly converges. That is, the convergence time period of the filter coefficient W(ω) depends on the magnitudes of the reference signal R(ω), the error signal E(ω), and the update parameter μ.

For example, when the amplitudes of the reference signal R(ω) and the error signal E(ω) are large, the filter coefficient W(ω) rapidly converges, whereas when the amplitudes of the reference signal R(ω) and the error signal E(ω) are small, the conversion of the filter coefficient W(ω) takes time. Therefore, the coefficient setter 135*a* performs multiplication of the update parameter μ in the course of the arithmetic process of the filter coefficient W(ω), thereby adjusting the convergence time period. In order to reduce the time required for the conversion, the update parameter μ has to be made large. However, a too large update parameter μ may lead to divergence, but not convergence. Therefore, the coefficient setter 135*a* has to set the update parameter μ within a range enabling the convergence.

Figure 3:
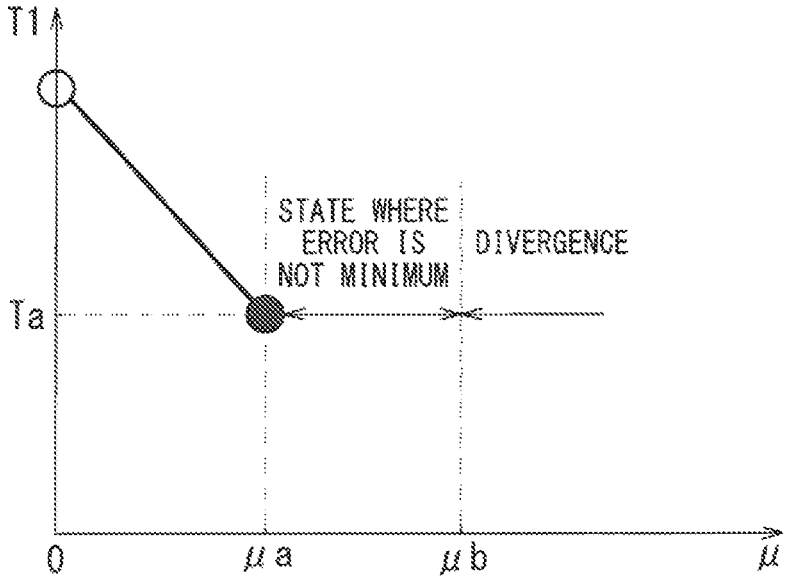
FIG. 3 is a graph illustrating the relationship between an update parameter and a convergence time period of the embodiment.

FIG. 3 shows the relationship between the update parameter μ and a time period T1 (convergence time period T1) required for the noise cancellation amount to reach a maximum amount in update control of the filter coefficient W. As the update parameter μ increases from 0, the convergence time period T1 is gradually reduced. Then, when the update parameter μ exceeds an optimal value μa, the filter coefficient W does not diverge but is in a state where the error is not minimum and in which the noise cancellation amount is not maximum. When the update parameter μ further increases and exceeds an upper limit value μb, the filter coefficient W diverges. That is, the optimal value μa is a boundary value between an update parameter μ at which the filter coefficient W converges and an update parameter μ at which the filter coefficient W is in the state where the error is not minimum. The upper limit value μb is a boundary value between the update parameter μ at which the filter coefficient W is in the state where the error is not minimum and an update parameter at which the filter coefficient W diverges. In general, when the relationship [optimal value μa=upper limit value μb/2] holds true and the update parameter μ=μa, the convergence time period T1=a minimum time period Ta.

Therefore, in the present embodiment, in order to approximate the update parameter μ to the optimal value μa, the update parameter μ is obtained by the logical expression shown in Formula 2. Note that Formula 2 is applied to the LMS in the frequency domain. In the Formula 2, the conjugate function of a transfer function C(ω)ˆ is represented by the transfer function Cˆ provided with the symbol *.

$$\mu = \frac{1}{|X(\omega)|^2 \cdot C(\omega) \cdot \hat{C}(\omega)^*} \quad \text{[Formula 2]}$$

Moreover, provided that there is no estimation error of the transfer function C(ω)ˆ, Formula 2 can be simplified as Formula 3.

$$\mu = \frac{1}{|X(\omega)|^2 \cdot |\hat{C}(\omega)|^2} \quad \text{[Formula 3]}$$

Then, Formula 3 is developed as Formula 4, so that the update parameter μ can be obtained as a function of the reference signal R(ω). That is, the update parameter μ decreases as the signal intensity of the output of the reference microphone 111 increases, whereas the update parameter μ increases as the signal intensity of the output of the reference microphone 111 decreases. Note that in Formula 2, the conjugate function of the reference signal R(ω) is denoted by reference signal R(ω) provided with the symbol *.

$$\begin{aligned} \mu &= \frac{1}{|X(\omega)|^2 \cdot |\hat{C}(\omega)|^2} \\ &= \frac{1}{|X(\omega) \cdot \hat{C}(\omega)|^2} \\ &= \frac{1}{|R(\omega)|^2} \\ &= \frac{1}{R(\omega) \cdot R(\omega)^*} \end{aligned} \quad \text{[Formula 4]}$$

The parameter adjuster 137 determines the update parameter μ based on Formula 4. First, the converter 133*b* accumulates the reference signals r(t) in the time domain and performs an FFT process on a predetermined number of samples of the reference signals r(t), which were accumulated, to determine the reference signal R(ω) in the frequency domain. The parameter adjuster 137 applies the reference signals R(ω) to Formula 4 to sequentially determine the update parameter μ and sequentially gives the determination result of the update parameter μ to the coefficient setter 135*a*. Specifically, the parameter adjuster 137 determines update parameters μ1 to μn in each corresponding to an associated one of the plurality of frequency bins. Note that when the update parameters μ1 to μn are not distinguished from each other, the update parameters are referred to as update parameters μ.

The coefficient setter 135*a* receives the reference signals R(ω) in the frequency domain and the error signals E(ω) in the frequency domain, and the parameter adjuster 137 sets the update parameters μ1 to μn each used by the LMS algorithm of a corresponding one of the frequency bins. The coefficient setter 135*a* executes the Filtered-X LMS algorithm in the frequency domain (see Formula 1) and calculates and outputs the filter coefficients W1(ω) to Wn(ω) each for a corresponding one of the frequency bins.

Therefore, even when the frequency characteristic of noise which is to be cancelled has a peak or a dip, setting of the filter coefficients W1(ω) to Wn(ω) each for a corresponding one of the frequency bins enables realization of a filter property suitable for the frequency characteristic of the noise.

The inverse converter 135*b* performs Inverse Fast Fourier Transform (inverse FFT), thereby converting the filter coefficients W1(ω) to Wn(ω) in the frequency domain calculated in the coefficient setter 135*a* respectively into the filter coefficients W1(t) to Wn(t) in the time domain. The filter coefficients W1(t) to Wn(t) each for a corresponding one of the frequency bins of the sound cancelling filter 136*a* are set by outputs of the inverse converter 135*b*.

The coefficient updater 135 sequentially updates the filter coefficients W1(t) to Wn(t) of the sound cancelling filter 136*a*. The sound cancelling filter 136*a* divides the noise signal X(t) into a plurality of noise signals X(t) each corresponding to one of the frequency bins, and for each of the frequency bins, the sound cancelling filter 136*a* performs convolution of a corresponding one of the filter coefficients W(t) and a corresponding one of the noise signals X(t). Then, the sound cancelling filter 136*a* outputs a sum of results of the convolution performed for the frequency bins. The output of the sound cancelling filter 136*a* is phase-inverted by the inverter 136*b*, thereby generating the cancellation signal Y(t). The cancellation signal Y(t) output from the cancellation signal generator 136 is subjected to D/A conversion in the D/A converter 126 and is then amplified in the amplifier 123 to output a cancelling sound from the loudspeaker 113.

The waveform of the cancelling sound (cancellation signal Y(t)) is generated to have an antiphase to the phase of a noise waveform at the noise cancellation point and an amplitude identical with the amplitude of the noise waveform. The cancelling sound reduces noise which propagates from the fan 22 through the duct 21 and which is to be released from the inlet 21*a*.

Figure 4:
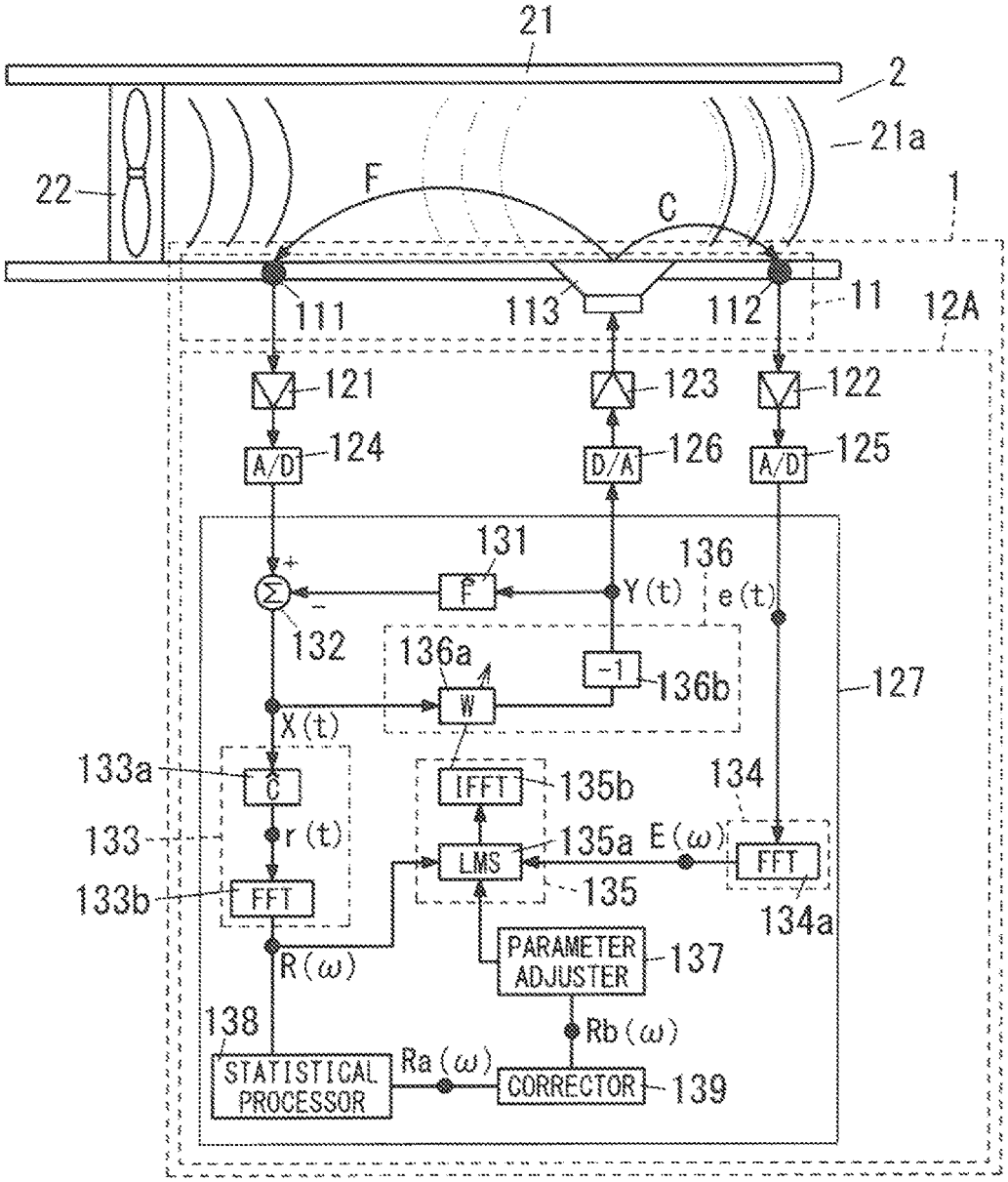
FIG. 4 is a block diagram illustrating the configuration of a variation of the embodiment.
Figure 5:
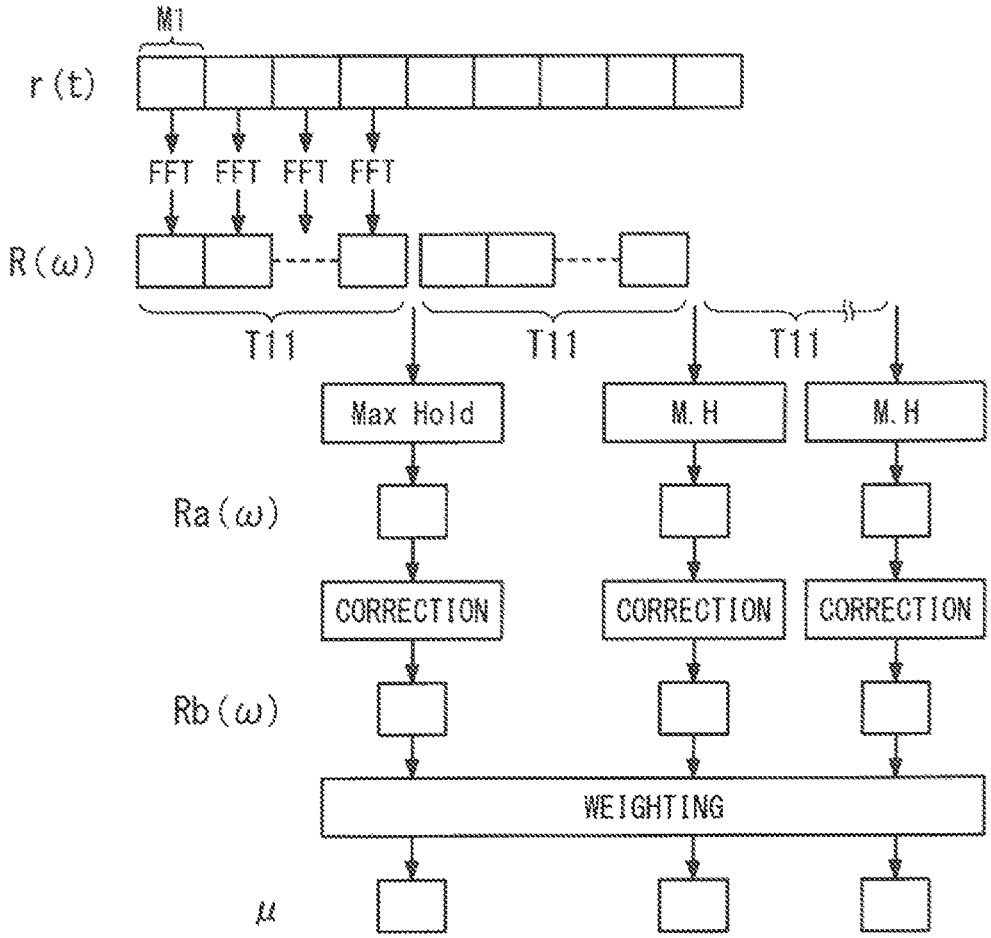
FIG. 5 is a view illustrating update control of the update parameter of the embodiment.

As illustrated in FIG. 4, a signal processing device 12A including a statistical processor 138 and a corrector 139 is also preferably used. With reference to FIG. 5, operation of the statistical processor 138 and operation of the corrector 139 will be described below.

First, a converter 133*b* accumulates reference signals r(t) in a time domain and performs an FFT process on M1 samples of the reference signals r(t), which have been accumulated, thereby determining a reference signal R(ω) in a frequency domain.

The statistical processor 138 performs spectrum estimation, where a predetermined number of samples of the reference signals R(ω) is defined as one block (analysis length T11). The statistical processor 138 sequentially performs statistical processing, where the reference signals R(ω) of the one block is defined as a target of the spectrum estimation. In this way, a reference signal Ra(ω) (fourth signal) is generated by a MaxHold (M.H) process. The reference signal Ra(ω) is generated by setting a signal intensity in each of the plurality of frequency bins as described below. The statistical processor 138 acquires signal intensities corresponding to one of the frequency bins from the predetermined number of samples of the reference signals R(ω). The statistical processor 138 sets one of the signal intensities which is to be a maximum value as the signal intensity of the reference signal Ra(ω) for the one frequency bin. The signal intensities of the reference signals Ra(ω) for the remaining frequency bins are set in a similar manner.

In this way, the spectrum estimation process including the MaxHold process in the statistical processor 138 enables the spectral distribution of the reference signals Ra(ω) to have a maximum characteristic of the reference signals R(ω) of the analysis length T11. Thus, the signal intensity of the reference signal Ra(ω) can be prevented from being set to a too small value.

Moreover, the corrector 139 performs a correction process on each reference signal Ra(ω). When the analysis length T11 of the statistical processor 138 is short, the signal intensity of the signal Ra(ω) becomes lower than an initial characteristic (long time period characteristic), and an error is more likely to occur. However, when the analysis length T11 of the statistical processor 138 is long, the signal intensity of the reference signal Ra(ω) becomes relatively high and substantially corresponds to the initial characteristic, and an error is less likely to occur. In the present embodiment, a short time measurement in which the analysis length T11 of the statistical processor 138 is short is performed, and therefore, the correction process by the corrector 139 is preferably performed.

Figure 6:
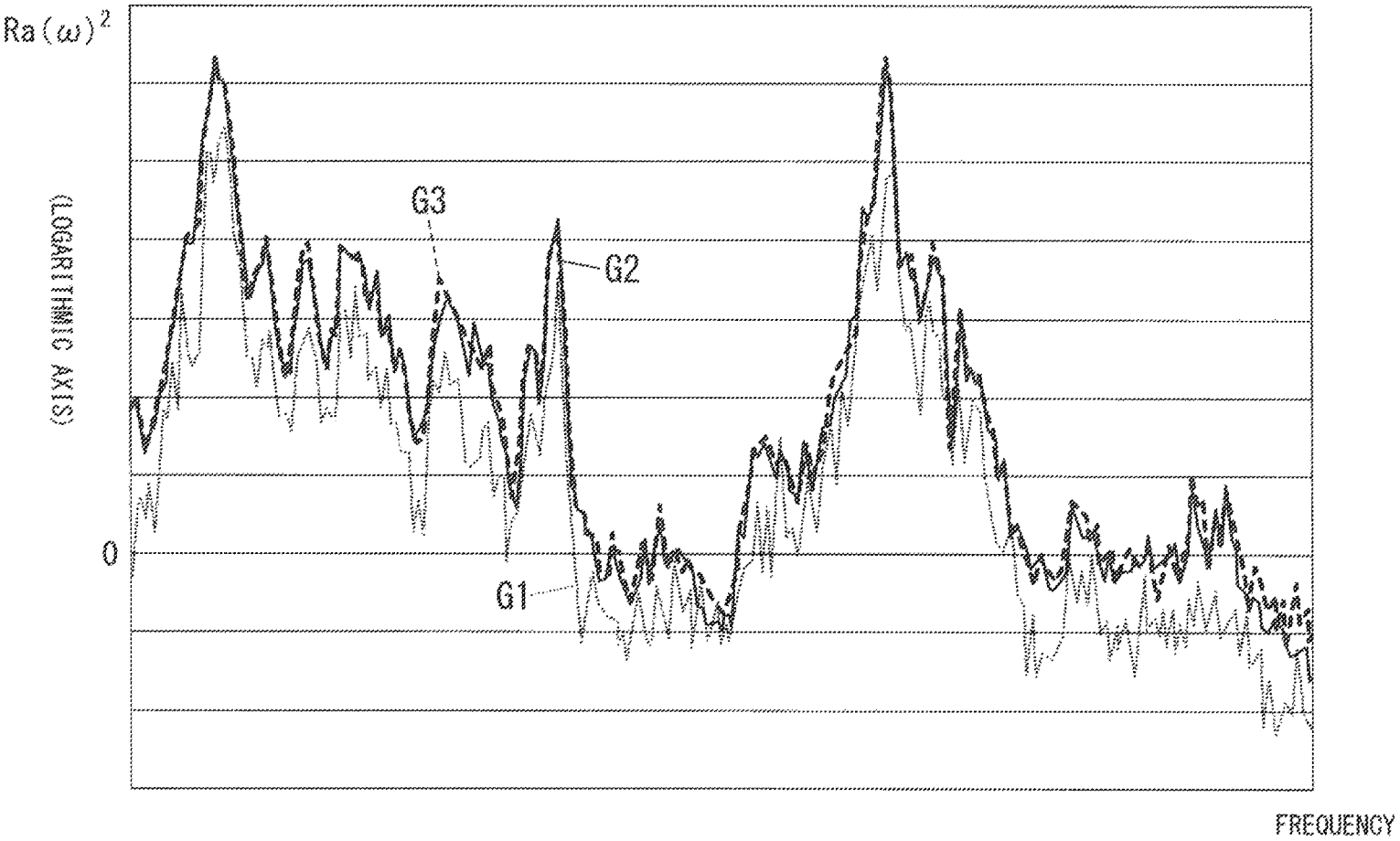
FIG. 6 is a graph illustrating the spectral distribution of a reference signal of the embodiment.
Figure 7:
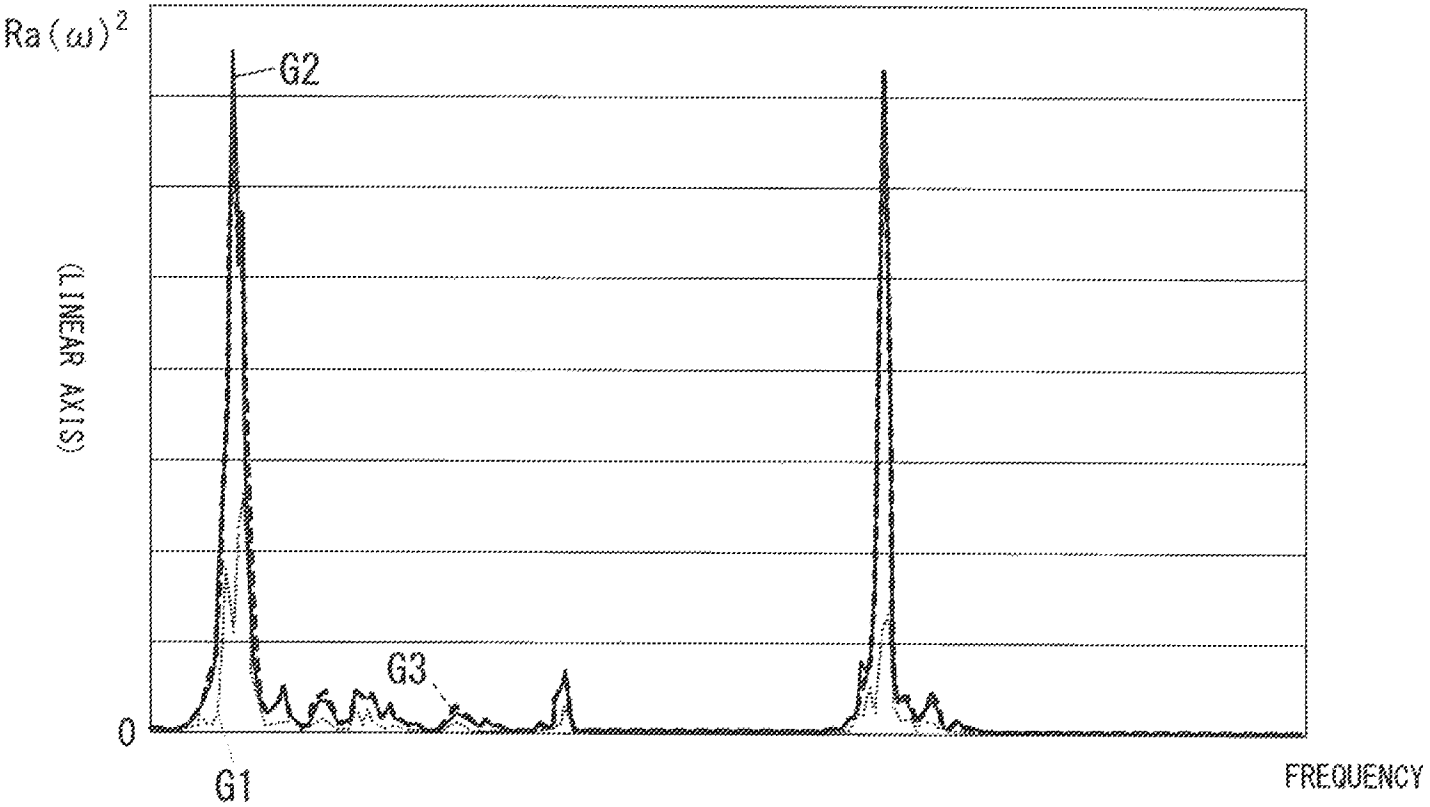
FIG. 7 is a graph illustrating a spectral distribution of the reference signal of the embodiment.

Specifically, FIG. 6 shows the spectral distribution of a square $Ra(\omega)^2$ of the reference signal Ra(ω), wherein three signal intensity characteristics with different analysis lengths T11 are shown. In FIG. 6, the ordinate along which the square $Ra(\omega)^2$ is shown is the logarithmic axis. A square $Ra(\omega)^2$ obtained from the statistical processor 138 of the present embodiment is shown as a characteristic G1 indicated by a thin broken line and has the shortest analysis length T11 (first number of samples). On the other hand, a square $Ra(\omega)^2$ in a case of the analysis length T11 being longer than that of the characteristic G1 is shown as a characteristic G2 indicated by a solid line, and a square $Ra(\omega)^2$ in a case of the analysis length T11 being longer than that of the characteristic G1 is shown as a characteristic G3 indicated by a thick broken line. The characteristic G2 indicated by the solid line is a characteristic in a case where the analysis length T11 is 100 times as long as that of the characteristic G1. The characteristic G3 indicated by the thick broken line is a characteristic in a case where the analysis length T11 is 200 times as long as that of the characteristic G1 (second number of samples). In FIG. 6, the characteristic G3 whose analysis length T11 is sufficiently long can be deemed as the initial characteristic of the square $Ra(\omega)^2$, and the characteristic G2 substantially corresponds to the characteristic G3. In contrast, the signal intensity of the characteristic G1 is lower than the signal intensities of the characteristics G2 and G3. Moreover, in FIG. 7, the ordinate of FIG. 6 is replaced with a linear axis. Also in this case, the signal intensity of the characteristic G1 is lower than the signal intensities of the characteristics G2 and G3.

Figure 8:
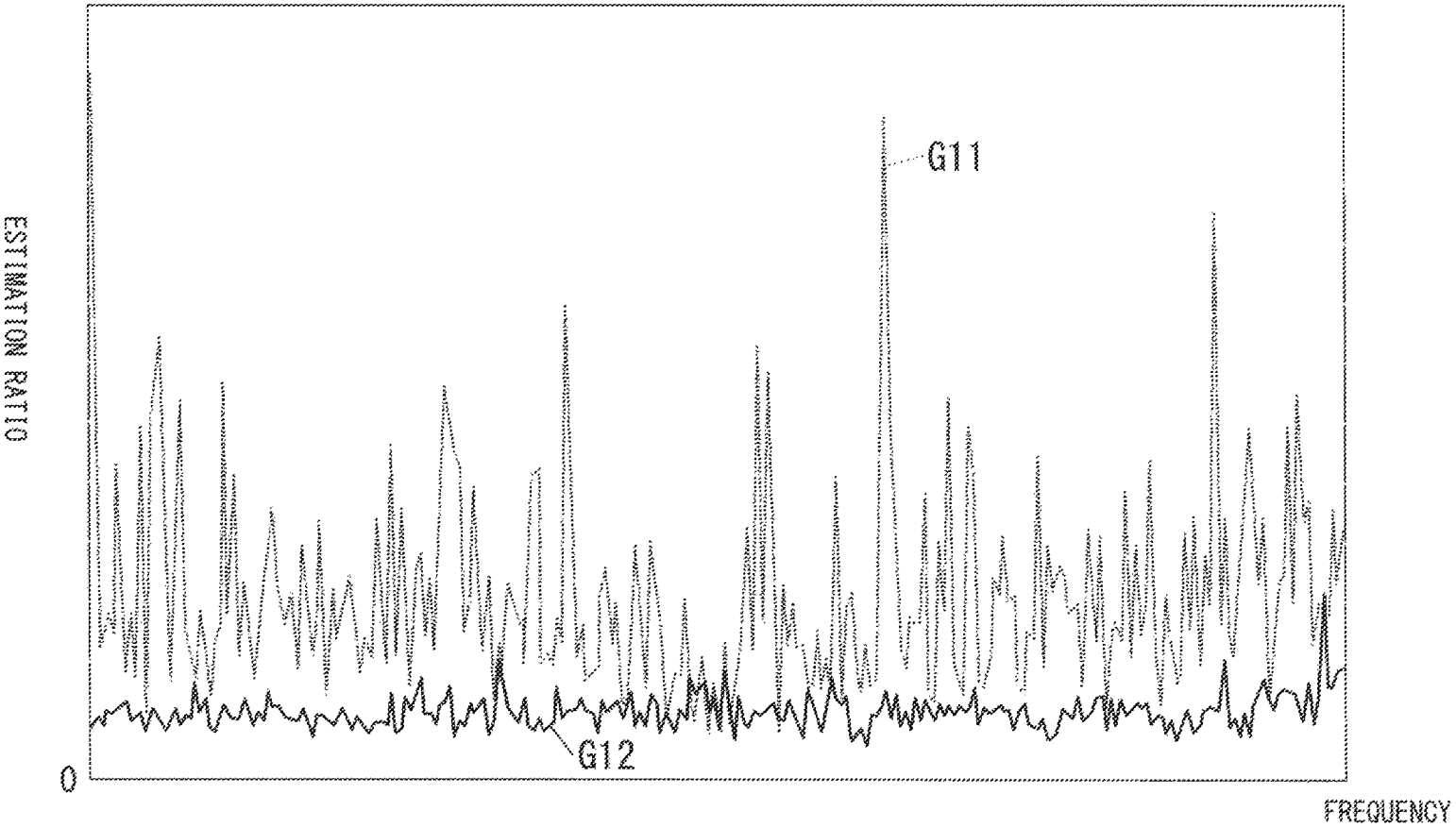
FIG. 8 is a graph illustrating the ratio of signal intensities of the reference signals of the embodiment.

FIG. 8 shows ratios of the signal intensity of the characteristic G3 to the signal intensity of the characteristic G1 and to the signal intensity of the characteristic G2 (estimation ratio). A characteristic G11 in FIG. 8 is the estimation ratio (=G3/G1) of the characteristic G1. A characteristic G12 in FIG. 8 is the estimation ratio (=G3/G2) of the characteristic G2. From the characteristic G11, it can be seen that the estimation ratio of the characteristic G1 is large, and that the characteristic G1 is smaller than the characteristic G3. From the characteristic G12, it can be seen that the estimation ratio of the characteristic G2 is substantially 1, and that the characteristic G2 substantially corresponds to the characteristic G3.

That is, it can be seen that the spectral distribution of the square $Ra(\omega)^2$ of the present embodiment, in which the analysis length T11 is short, has a signal intensity lower than the signal intensity of the initial spectral distribution.

Therefore, the corrector 139 defines the square root of the estimation ratio of the characteristic G1 as a correction parameter and multiplies the reference signal Ra(ω) by the correction parameter to correct the reference signal Ra(ω). That is, when the estimation ratio of the characteristic G1 is ninefold, the corrector 139 determines that the correction parameter =3, and the corrector 139 multiplies the reference signal Ra(ω) by 3, thereby determining a corrected reference signal Rb(ω)(=Ra(ω)×3).

That is, the reference signal Ra(ω) has a local maximum characteristic in a short time, and an error between the local maximum characteristic and a maximum characteristic of a population of a long time analysis of a noise signal has to be calculated. According to the above description, the estimation ratio (characteristic G11) of the characteristic G1 is the error of the reference signal Ra(ω) with respect to the maximum characteristic of the population. The error is obtained through an experiment, a simulation, or the like in advance, and the corrector 139 multiplies the reference signal Ra(ω) by the correction parameter to correct the error, thereby determining the corrected reference signal Rb(ω).

Thus, since it is possible to prevent that the reference signal is estimated to be lower than in reality, update parameters μ do not become too large (see Formula 4), and diversion of the filter coefficients W(ω) can be suppressed.

The parameter adjuster 137 determines each update parameter μ based on Formula 5. Specifically, the parameter adjuster 137 determines the update parameters μ1 to μn respectively corresponding to the filter coefficients W1(ω) to Wn(ω).

$$\mu = \frac{1}{|Rb(\omega)|^2} = \frac{1}{Rb(\omega)\cdot Rb(\omega)^*} \quad \text{[Formula 5]}$$

At this time, the parameter adjuster 137 preferably uses a forgetting factor α to determine each update parameter μ. Specifically, the parameter adjuster 137 stores the history of reference signals Rb(ω) in the past and weights a reference signal Rb(i)(ω) and a reference signal Rb(i−1)(ω) based on Formula 6. Note that (i) in Formula 6 is the newest sample number of Rb(ω), and (i−1) is a sample number directly preceding the Rb(ω). The forgetting factor α is preset in a range $0 \le \alpha \le 1$, the reference signal Rb(i)(ω) is multiplied by the forgetting factor α, and the reference signal Rb(i−1)(ω) is multiplied by α−1, thereby determining a sum of the results of the multiplications as the reference signal Rb(ω). Then, the parameter adjuster 137 determines each update parameter μ based on Formula 5.

$$Rb(\omega)=Rb(i)(\omega)\times\alpha+Rb(i-1)(\omega)\times(\alpha-1) \quad \text{[Formula 6]}$$

That is, an update parameter μ(i) of the present and an update parameter μ(i−1) of the past are weighted and are totaled, thereby reducing unexpected fluctuations.

Moreover, the coefficient setter 135*a* uses a known sequential update control algorithm called Filtered-X LMS in the frequency domain, but a sequential update control algorithm in the time domain may be used. In this case, a FFT process and an inverse FFT process are no longer required.

Note that the above-described embodiment is an example of the present invention. Therefore, the present invention is not limited to the above-described embodiment. Even in embodiments other than the embodiment, various modifications may be made depending on design, and the like without departing from the technical idea of the present invention.

The above-described embodiment clearly shows that a signal processing device 12 of a first aspect according to the present invention is used in combination with a sound input/output device 11. The sound input/output device 11 includes a reference microphone 111 (first sound input device), an error microphone 112 (second sound input device), and a loudspeaker 113 (sound output device). The reference microphone 111 is disposed in a duct 21 (space) in which noise generated from a fan 22 (noise source) propagates, and the reference microphone 111 collects the noise. The loudspeaker 113 receives a cancellation signal Y(t) and outputs a cancelling sound for cancelling the noise in the duct 21. The error microphone 112 collects a synthesis sound of the noise and the cancelling sound in the duct 21. The signal processing device 12 includes a cancellation signal generator 136, a first signal converter 133, a coefficient updater 135, and a parameter adjuster 137. The cancellation signal generator 136 includes the sound cancelling filter 136*a* having filter coefficients W (W(t)) and receives a noise signal X(t) (first signal) generated based on an output of the reference microphone 111 to output the cancellation signal Y(t). The first signal converter 133 outputs a reference signal R(ω) (second signal) obtained by correcting the noise signal X(t) based on a transfer function C of an acoustic passage from the loudspeaker 113 to the error microphone 112. The coefficient updater 135 calculates a new filter coefficient based on a plurality of the reference signals R(ω), error signals E(ω) (third signals) generated from outputs of the error microphone 112, and update parameters μ, and updates each of the filter coefficients of the sound cancelling filter 136*a* to the new filter coefficient. The update parameter μ relates to the magnitude of the correction amount of the filter coefficient W in a process for repeatedly calculating the filter coefficient W. The parameter adjuster 137 adjusts the update parameter μ based on output fluctuation of the reference microphone 111.

Thus, the signal processing device 12 of the present embodiment generates the noise signal X(t) by subtracting a wraparound component of the cancelling sound from a noise signal collected by the reference microphone 111. Then, the parameter adjuster 137 updates the update parameter μ based on the reference signals R(ω) generated from the noise signal X(t) and can set an update parameter μ according to the noise signal collected by the reference microphone 111. That is, the update parameter μ corresponds in real time to the noise collected by the reference microphone 111, and the filter coefficients W corresponding to fluctuation of the noise in real time are determined and are set in the sound cancelling filter 136*a*. Therefore, the signal processing device 12 can more accurately cancel noise which fluctuates according to changes in environmental conditions such as temperatures, humidity, and atmospheric pressures.

For example, noise collected by the reference microphone 111 in the range hood device 2 fluctuates according to, for example, changes in static pressure, changes in temperature, and changes in humidity in the duct 21. The signal processing device 12 of the present embodiment can more accurately cancel noise of the range hood device 2 which fluctuates according to changes in environmental conditions such as temperatures, humidity, and atmospheric pressures.

In a signal processing device 12 of a second aspect according to the present invention referring to the first aspect, as the update parameter μ decreases, a convergence time period T1 of a process for calculating the new filter coefficient by the coefficient updater 135 increases (see FIG. 3). The parameter adjuster 137 preferably reduces the value of the update parameter μ when the signal intensity of the output of the reference microphone 111 increases, whereas the parameter adjuster 137 preferably increases the value of the update parameter μ when the signal intensity of the output of the reference microphone 111 decreases (see Formula 4).

In this case, the signal processing device 12 can suppress the occurrence of a divergence state of the filter coefficients W and the occurrence of a state where the error is not minimum with respect to noise which fluctuates according to changes in environmental conditions such as temperatures, humidity, and atmospheric pressures, thereby reducing the convergence time period T1 of the update control. The signal processing device 12 of the present embodiment obtains the update parameter μ t used for update controlling of the filter coefficients W by an LMS algorithm according to Formula 4 described above.

A signal processing device 12 of a third aspect according to the present invention referring to the first aspect or the second aspect further includes a second signal converter 134 configured to generate an error signal E(ω) in a frequency domain from error signals e(t) in a time domain output from the error microphone 112. The first signal converter 133 is preferably configured to convert reference signals r(t) in a time domain into a reference signal R(ω) in a frequency domain to output the reference signal R(ω). The sound cancelling filter 136*a* is configured to divide a predetermined frequency band into a plurality of frequency bins and has the filter coefficients W (W(t)) each for a corresponding one of the plurality of frequency bins. The coefficient updater 135 is configured to calculate the filter coefficients W (W(ω)) each for the corresponding one of the plurality of frequency bins in a frequency domain. The parameter adjuster 137 is configured to adjust update parameters μ1 to μn each corresponding to an associated one of the plurality of frequency bins.

In this case, even when the frequency characteristic of noise to be cancelled has a peak or a dip, the signal processing device 12 can set filter coefficients W (W1 to Wn) each for a corresponding one of the frequency bins, thereby producing the cancelling sound according to the frequency characteristic of the noise. Therefore, even when the frequency characteristic of noise to be cancelled includes a peak or a dip, the signal processing device 12 can maintain noise cancellation performance.

In a signal processing device 12 of a fourth aspect according to the present invention referring to the third aspect, the parameter adjuster 137 preferably uses fluctuation of a plurality of the reference signals R(ω) as the output fluctuation of the reference microphone 111 to adjust the update parameters μ based on the fluctuation of the reference signals R(ω).

Specifically, the signal processing device 12 performs convolution of the noise signal X(t) and a transfer function CA, performs a FFT process on the result of the convolution to obtain the reference signal R(ω), and determines the update parameter μ based on the reference signals R(ω). That is, the signal processing device 12 uses the fluctuation of the reference signals R(ω) as the output fluctuation of the reference microphone 111. Alternatively, there is a method in which the FFT process is individually performed on the noise signal X(t) and on the transfer function Cˆ, and convolution of the noise signal X(ω), which was FFT-processed, and the transfer function Cˆ, which was FFT-processed, is preformed to obtain the reference signal R(ω). In the former method, which the present embodiment adopts, the update parameter μ can be determined by performing the FFT process once, whereas in the latter method, the FFT process has to be performed twice to determine the update parameter μ. Thus, the signal processing device 12 can reduce the number of FFT processes, thereby reducing the operation load.

A signal processing device 12 of a fifth aspect according to the present invention referring to the third aspect or the fourth aspect preferably includes a statistical processor 138 and a corrector 139. The statistical processor 138 obtains signal intensities each for a corresponding one of the plurality of frequency bins from a predetermined number of samples of reference signals R(ω) (in an analysis length T11). The statistical processor 138 generates a reference signal Ra(ω) (fourth signal) through statistical processing for setting one of the plurality of obtained signal intensities which is a maximum value as a signal intensity of the frequency bin. The corrector 139 corrects the reference signal Ra(ω) based on the ratio of a first signal intensity and a second signal intensity. Here, the first signal intensity is an intensity of a signal generated by statistical processing, where the number of samples of the reference signal R(ω) is the first number of samples. The second signal intensity is an intensity of a signal generated by statistical processing, where the number of samples of the reference signal R(ω) is the second number of samples which is larger than the first number of samples. The parameter adjuster 137 determines the update parameter μ by using the reference signal Ra(ω) corrected in the corrector 139.

Thus, it is possible to prevent the reference signal from being estimated to be smaller than in reality. Therefore, the update parameters μ do not become too large, and it is possible to reduce the divergence of the filter coefficients W(ω). That is, the signal processing device 12 can obtain a reference signal Rb(ω) which is similar to the initial characteristic by a measurement process which takes a short time. Therefore, the signal processing device 12 enables the update parameters μ to further approximate to the optimal value μa.

In a signal processing device 12 of a sixth aspect according to the present invention referring to any one of the first to fifth aspects, the parameter adjuster 137 preferably determines the update parameter μ by using the forgetting factor α. In this case, unexpected fluctuation of the update parameter μ due to noise, or the like can be reduced.

A program of a seventh aspect according to the present invention causes a computer to function as the signal processing device 12.

This program can accurately cancel the noise fluctuating according to changes in environmental conditions such as temperatures, humidity, and atmospheric pressures.

A range hood device 2 of an eighth aspect according to the present invention includes a hollow duct 21 (air passage), a fan 22 (air blowing device), a reference microphone 111 (first sound input device), a loudspeaker 113 (sound output device), an error microphone 112 (second sound input device), and the signal processing device 12. The error microphone 112, the loudspeaker 113, and the reference microphone 111 are disposed in this order from a first end to a second end of the duct 21. The fan 22 generates an airflow from the first end to the second end of the duct 21. The reference microphone 111 is disposed in the duct 21 to collect noise generated from the fan 22. The loudspeaker 113 receives a cancellation signal to output a cancelling sound for cancelling the noise in the duct 21. The error microphone 112 collects a synthesis sound of the noise and the cancelling sound in the duct 21.

According to the range hood device 2, noise fluctuating according to changes in environmental conditions such as temperatures, humidity, and atmospheric pressures can be more accurately cancelled.

The invention claimed is:

1. A signal processing device used in combination with a sound input/output device including a first sound input device disposed in a space in which noise output from a noise source propagates, the first sound input device being configured to collect the noise, a sound output device configured to receive a cancellation signal to output a cancelling sound for cancelling the noise to the space, and a second sound input device configured to collect a synthesis sound of the noise and the cancelling sound in the space, the signal processing device, comprising:

a cancellation signal generator which includes a sound cancelling filter having a filter coefficient and which is configured to receive a first signal generated based on an output of the first sound input device to output the cancellation signal;

a first signal converter configured to output a second signal obtained by correcting the first signal based on a transfer function of an acoustic passage from the sound output device to the second sound input device;

a coefficient updater configured to calculate a new filter coefficient based on the second signal, a third signal generated from an output of the second sound input device, and an update parameter relating to a magnitude of a correction amount of the filter coefficient, and update the filter coefficient of the sound cancelling filter to the new filter coefficient; and a parameter adjuster configured to adjust the update parameter in response to output fluctuation of the first sound input device.

2. The signal processing device according to claim 1, wherein as the update parameter decreases, a convergence time period of a process for calculating the new filter coefficient by the coefficient updater increases, and the parameter adjuster reduces a value of the update parameter when a signal intensity of the output of the first sound input device increases, whereas the parameter adjuster increases the value of the update parameter when the signal intensity of the output of the first sound input device decreases.

3. The signal processing device according to claim 1, further comprising:

a second signal converter configured to convert signals in a time domain output from the second sound input device into a signal in a frequency domain to generate the third signal, wherein the first signal converter is configured to convert signals in a time domain into a signal in a frequency domain to output the signal in the frequency domain as the second signal, the sound cancelling filter is configured to divide a predetermined frequency band into a plurality of frequency bins and has a plurality of the filter coefficients each for a corresponding one of the plurality of frequency bins, the coefficient updater is configured to calculate the plurality of the filter coefficients each for the corresponding one of the plurality of frequency bins in a frequency domain, and the parameter adjuster is configured to adjust a plurality of the update parameters each corresponding to an associated one of the plurality of frequency bins.

4. The signal processing device according to claim 3, wherein the parameter adjuster uses fluctuation of a plurality of the second signals as output fluctuation of the first sound input device to adjust the update parameters based on the fluctuation of the plurality of the second signals.

5. The signal processing device according to claim 3, further comprising:

a statistical processor configured to obtain signal intensities each for a corresponding one of the plurality of frequency bins from a predetermined number of samples of a plurality of the second signals and generate a fourth signal through statistical processing for setting one of the signal intensities which has a maximum value as a signal intensity of a frequency bin for each of the plurality of frequency bins; and a corrector configured to correct the fourth signal based on a ratio of a signal intensity of a signal generated through the statistical processing when a total number of samples of the second signals is a first number of samples to a signal intensity of a signal generated through the statistical processing when a total number of samples of the second signals is a second number of samples larger than the first number of samples, wherein the parameter adjuster determines the update parameter by using the fourth signal including corrected in the corrector.

6. The signal processing device according to claim 1, wherein the parameter adjuster determines the update parameter by using a forgetting factor.

7. A non-transitory computer-readable recording medium recording a program causing a computer to function as the signal processing device according to claim 1.

8. A range hood device, comprising:

an air passage which is hollow;

an air blowing device configured to generate an airflow from a first end toward a second end of the air passage;

a first sound input device disposed in the air passage to collect noise generated from the air blowing device;

a sound output device configured to receive a cancellation signal to output a cancelling sound for cancelling the noise in the air passage;

a second sound input device configured to collect a synthesis sound of the noise and the cancelling sound in the air passage; and the signal processing device according to claim 1, wherein the second sound input device, the sound output device, and the first sound input device are arranged in this order from the first end toward the second end of the air passage.

9. The signal processing device according to claim 2, further comprising:

a second signal converter configured to convert signals in a time domain output from the second sound input device into a signal in a frequency domain to generate the third signal, wherein the first signal converter is configured to convert signals in a time domain into a signal in a frequency domain to output the signal in the frequency domain as the second signal, the sound cancelling filter is configured to divide a predetermined frequency band into a plurality of frequency bins and has a plurality of the filter coefficients each for a corresponding one of the plurality of frequency bins, the coefficient updater is configured to calculate the plurality of the filter coefficients each for the corresponding one of the plurality of frequency bins in a frequency domain, and the parameter adjuster is configured to adjust a plurality of the update parameters each corresponding to an associated one of the plurality of frequency bins.

10. The signal processing device according to claim 9, wherein the parameter adjuster uses fluctuation of a plurality of the second signals as output fluctuation of the first sound input device to adjust the update parameters based on the fluctuation of the plurality of the second signals.

11. The signal processing device according to claim 4, further comprising:

a statistical processor configured to obtain signal intensities each for a corresponding one of the plurality of frequency bins from a predetermined number of samples of a plurality of the second signals and generate a fourth signal through statistical processing for setting one of the signal intensities which has a maximum value as a signal intensity of a frequency bin for each of the plurality of frequency bins; and a corrector configured to correct the fourth signal based on a ratio of a signal intensity of a signal generated through the statistical processing when a total number of samples of the second signals is a first number of samples to a signal intensity of a signal generated through the statistical processing when a total number of samples of the second signals is a second number of samples larger than the first number of samples, wherein the parameter adjuster determines the update parameter by using the fourth signal including corrected in the corrector.

12. The signal processing device according to claim 9, further comprising:

a statistical processor configured to obtain signal intensities each for a corresponding one of the plurality of frequency bins from a predetermined number of samples of a plurality of the second signals and generate a fourth signal through statistical processing for setting one of the signal intensities which has a maximum value as a signal intensity of a frequency bin for each of the plurality of frequency bins; and a corrector configured to correct the fourth signal based on a ratio of a signal intensity of a signal generated through the statistical processing when a total number of samples of the second signals is a first number of samples to a signal intensity of a signal generated through the statistical processing when a total number of samples of the second signals is a second number of samples larger than the first number of samples, wherein the parameter adjuster determines the update parameter by using the fourth signal including corrected in the corrector.

13. The signal processing device according to claim 10, further comprising:

a statistical processor configured to obtain signal intensities each for a corresponding one of the plurality of frequency bins from a predetermined number of samples of a plurality of the second signals and generate a fourth signal through statistical processing for setting one of the signal intensities which has a maximum value as a signal intensity of a frequency bin for each of the plurality of frequency bins; and a corrector configured to correct the fourth signal based on a ratio of a signal intensity of a signal generated through the statistical processing when a total number of samples of the second signals is a first number of samples to a signal intensity of a signal generated through the statistical processing when a total number of samples of the second signals is a second number of samples larger than the first number of samples, wherein the parameter adjuster determines the update parameter by using the fourth signal including corrected in the corrector.

14. The signal processing device according to claims 2, wherein the parameter adjuster determines the update parameter by using a forgetting factor.

15. The signal processing device according to claims 3, wherein the parameter adjuster determines the update parameter by using a forgetting factor.

16. The signal processing device according to claims 4, wherein the parameter adjuster determines the update parameter by using a forgetting factor.

17. The signal processing device according to claims 5, wherein the parameter adjuster determines the update parameter by using a forgetting factor.

18. The signal processing device according to claims 9, wherein the parameter adjuster determines the update parameter by using a forgetting factor.

19. The signal processing device according to claims 10, wherein the parameter adjuster determines the update parameter by using a forgetting factor.

20. The signal processing device according to claims 11, wherein the parameter adjuster determines the update parameter by using a forgetting factor.

* * * * *